US010163372B1

(12) United States Patent
Esmail

(10) Patent No.: US 10,163,372 B1
(45) **Date of Patent: *Dec. 25, 2018**

(54) SELF-DESTRUCTIVE DOCUMENTS FOR INFORMATION SECURITY AND PRIVACY PROTECTION

(71) Applicant: Kemaal Akber Esmail, Mountain View, CA (US)

(72) Inventor: Kemaal Akber Esmail, Mountain View, CA (US)

(73) Assignee: Invaluable Inventions, Mountaion View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/853,900

(22) Filed: Dec. 25, 2017

Related U.S. Application Data

(63) Continuation-in-part of application No. 15/631,951, filed on Jun. 23, 2017.

(51) Int. Cl.
*G09F 3/02* (2006.01)
*G09F 3/10* (2006.01)

(52) U.S. Cl.
CPC ..... *G09F 3/02* (2013.01); *G09F 3/10* (2013.01); *G09F 2003/0201* (2013.01); *G09F 2003/0222* (2013.01); *G09F 2003/0269* (2013.01); *G09F 2003/0273* (2013.01); *G09F 2003/0277* (2013.01)

(58) Field of Classification Search
CPC ..... G09F 3/02; G09F 3/10; G09F 2003/0201; G09F 2003/0222; G09F 2003/0269; G09F 2003/0273; Y10T 428/14; B42D 25/00
See application file for complete search history.

(56) References Cited

U.S. PATENT DOCUMENTS 2,374,723 A * 5/1945 Barghausen ..... B42D 25/29 283/103
3,221,427 A * 12/1965 Kaplan ..... G09F 3/0292 206/831
4,947,567 A * 8/1990 Hermann ..... G09F 3/0292 40/630
5,484,996 A * 1/1996 Wood ..... G09F 3/0297 235/487

(Continued)

FOREIGN PATENT DOCUMENTS

JP 2013-156519 A 8/2013

OTHER PUBLICATIONS

International Search Report and Written Opinion of the International Searching Authority for PCT/US2018/039046, all pages.

*Primary Examiner* — Patricia L. Nordmeyer
(74) *Attorney, Agent, or Firm* — Mark E. T. Penfold

(57) ABSTRACT

The inventor here discloses destructive (self-destructing) documents useful for the protection of confidential information. The invention comprises a document which can be easily and instantly broken down into dozens of individual components, hence obliterating any information contained thereon. As the self-destruction of the document requires no extraneous equipment for destruction and guarantees elimination of readable data, the invention represents a vast improvement over the state of the art. Numerous embodiments of the document of the invention specialized for different applications are illustrated and described.

11 Claims, 9 Drawing Sheets

(56) References Cited

U.S. PATENT DOCUMENTS

| | | | | | |
|---|---|---|---|---|---|
| 5,893,587 | A * | 4/1999 | Wong | G09F 3/0292 | 283/72 |
| 5,895,075 | A * | 4/1999 | Edwards | G06K 7/1434 | 283/100 |
| 6,635,326 | B2 * | 10/2003 | Ueki | B42D 15/00 | 40/324 |
| 6,670,008 | B1 * | 12/2003 | Ognissanti | G09F 3/0292 | 428/40.1 |
| 7,166,345 | B2 * | 1/2007 | Myers | G09F 3/0292 | 283/81 |
| 7,909,363 | B2 * | 3/2011 | Anderson | G09F 3/0288 | 283/100 |
| D650,017 | S * | 12/2011 | Bevan | D20/27 | |
| 8,814,218 | B2 * | 8/2014 | Liu | G09F 3/0292 | 283/81 |
| 9,779,641 | B1 * | 10/2017 | Esmail | B42D 25/00 | |
| 2001/0033908 | A1 | 10/2001 | Ueki | | |
| 2005/0196573 | A1 | 9/2005 | Myers | | |
| 2006/0257608 | A1 * | 11/2006 | Severn | G09F 3/0292 | 428/40.1 |
| 2007/0130811 | A1 * | 6/2007 | Shevelev | B65D 55/0818 | 40/312 |
| 2008/0102238 | A1 * | 5/2008 | Swords | G09F 3/0292 | 428/40.1 |
| 2014/0262903 | A1 * | 9/2014 | Mitten | B65D 55/06 | 206/459.5 |

* cited by examiner

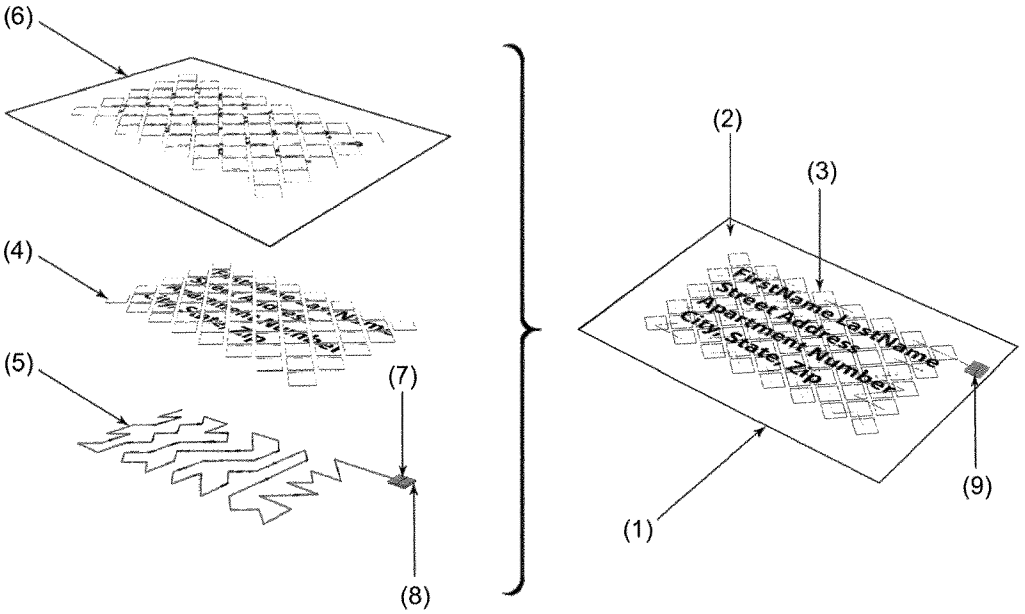
FIG. 1A
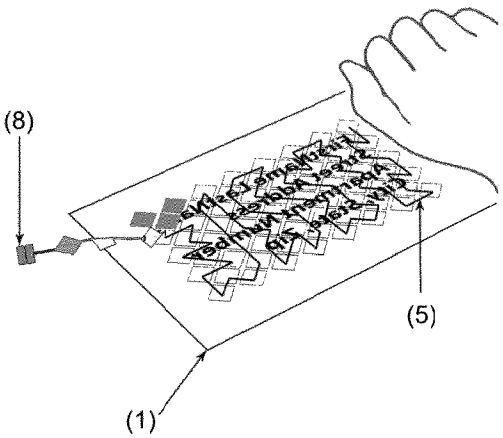
FIG. 1B
FIG. 1C

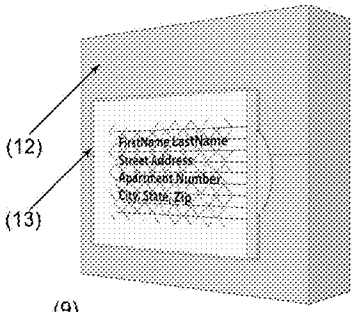
FIG. 4B
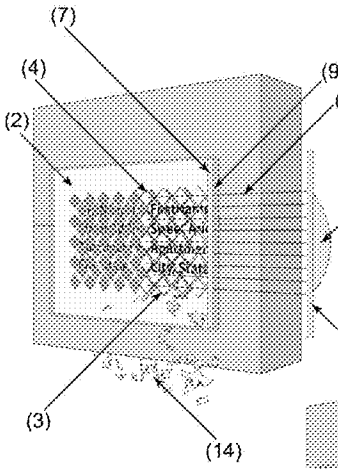
FIG. 4C
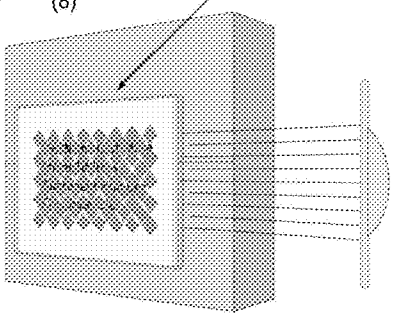
FIG. 4D
FIG. 4E
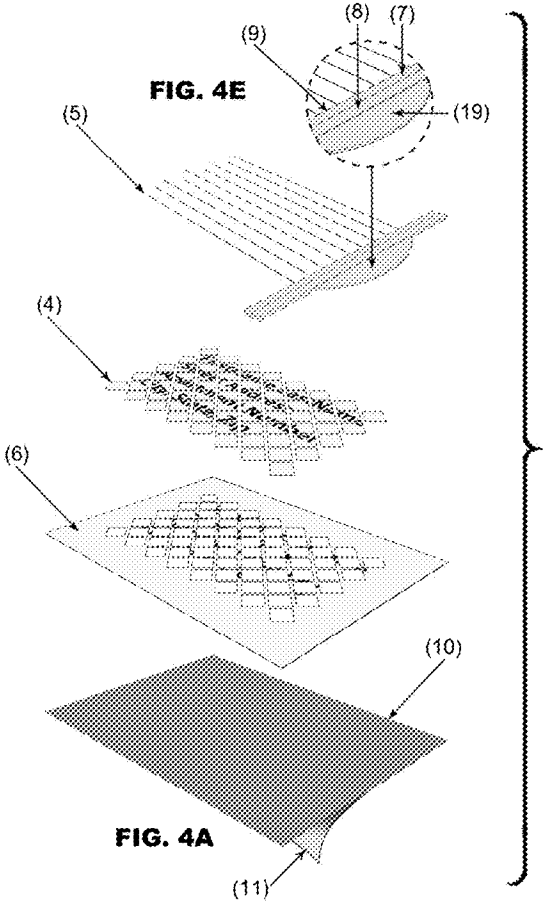
FIG. 4A

SELF-DESTRUCTIVE DOCUMENTS FOR INFORMATION SECURITY AND PRIVACY PROTECTION

BACKGROUND OF THE INVENTION

Threats to data privacy and identity theft are increasingly common, resulting in untold anguish, and hundreds of millions in losses yearly to those who have their personal or corporate information stolen and abused. But while online hacking, phishing and other computer aided theft of personal information makes newspaper headlines, masses of such information is still stolen the old fashioned way, by extracting information from printed personal communications which end in the trash, commonly known as dumpster diving.

The myriad of items passing through a typical mailbox, some solicited, others beyond the control of the individual, contain a wealth of information in public view, from names and addresses, to other more private information not designed for public disclosure. Further, information contained in medical mailings and prescription containers is highly confidential and open to abuse. Currently such items have no quick and simple way to assure that this information is destroyed, and the use of information purloined from discarded mailings and the like remains a huge problem to which the instant invention provides a solution.

In addition, data theft and espionage within industry are increasingly common. Even in an office with strict environmental controls such as a secured intranet and the absence of file save facilities on sensitive equipment, the necessity of hand-written notes and temporary memos remains a weak link in an otherwise secure system.

While numerous solutions exist to protect such private information, these most often require extraneous equipment, such as paper shredding, or may result in incomplete erasure of information, as is usually the case with simple paper ripping, use of concealment stamps and markers or the like. Lacking real world utility the currently available solutions fail to address a pressing need. The inventor herein discloses a destructive (eg. self-destructing or self-shredding) document, and provides a series of solutions to the theft of personal, medical and industrial information consequently providing a superior level of privacy and protection.

BRIEF SUMMARY OF THE INVENTION

The instant invention provides a series of solutions to the theft of personal, medical and industrial information. In summary, the invention comprises a printable surface called a coversheet. Using a pattern of light cuts or perforations, the coversheet is partitioned into a series of releasable island cutouts and a residual framework, such that the integrity of the page is maintained, but each cutout can be released from the page using only minimal force, due to the presence of the perforations. In order to release the cutouts the coversheet is overlain with a divider, consisting of a sheet or filament which is spot adhered to the cutouts and separates them from the coversheet when pulled upon. In some instances the divider is a filament or tape which overlays and joins the cutouts, and may terminate in a tab, which can be pulled upon to release each or sequentially all of the cutouts from the coversheet as chads, hence removing the portions of printed or written matter that reside on the cutouts. In other instances the divider may be a sheet which is spot adhered to the cutouts and releases all the cutouts from the coversheet when removed. To further obfuscate the information the invention also includes a stripping device to remove each chad from the divider and complete document destruction. When the divider is a filament, the stripping device may encircle it and release the individual chads as it is drawn along the filament length. Alternatively the stripper may comprise a separate layer between the coversheet and divider. In some embodiments the coversheet is adhered to an adhesive backing sheet with an optional release liner, allowing it to be affixed to items as desired. In all embodiments the instant invention renders destruction of the printed surface and obliteration of any readable text. Further details and embodiments are discussed below.

The invention comprises the following elements:

one or more coversheets, sometimes with an optional topsheet one or more dividers one or more stripping devices, sometimes with an optional shredder The invention may also comprise one or more optional backing sheets and optional associated release liners, each of which are further detailed below, followed by a description of certain preferred embodiments. For brevity, the singular is used within the text to refer to the above elements, but is intended to include one or more of the referenced elements where appropriate.

A first element of the invention comprises one or more coversheets. The coversheet is typically a piece of paper, plastic, polymer, cloth, metal, or other suitable material. The upper surface comprises a writable or printable surface, on which hand writing, printing, graphics, mailing and other information can be entered. In some instances the text may be applied to the coversheet through one or more overlaying layers using thermal printing. In some instances the lower surface may also comprise a writable surface. The coversheet is cut or perforated with a series of island outlines or "cutouts" using methods such as die or laser cutting well known in the art and commonly employed in the production of stickers, adhesive labels, stamps, toilet paper etc. The cutouts may be the same or different shapes and sizes, and their patterning on the coversheet may be uniform or random, and may cover all or a part of the coversheet. Dimensions, sizes and shapes of the cutouts will depend on font type, font characters and font size, document format etc, and can be chosen to maximize data masking. Typical cryptographic methods of obscuring the information can be employed to optimize these parameters to ensure the information is indeterminate after destruction and cannot forensically be reassembled. In some embodiments the coversheet is adhered to an underlying backing sheet with optional release liner. In some embodiments the backing sheet is transparent. When no backing sheet is present, the cutting or perforation shall usually be such that the cutouts are substantially separated from the coversheets, but the integrity of the page is maintained, and each cutout can be released from the page using only minimal force due to the presence of the perforations. When a backing sheet is present to further support the cutouts, the cuts/perforations may be such that the cutouts are more easily released from the backing and coversheets to leave the residual coversheet lattice affixed to the underlying backing sheet. In some embodiments in which a backing sheet is employed, the coversheet may be akin to a perforated sticker and the coversheet's lower surface is covered in an adhesive which can form a releasable bond with the underlying upper surface of the backing sheet, which is formulated as a release layer as further described below. In some embodiments in which a backing sheet is employed, the coversheet may further comprise a clear topsheet which overlays the coversheet and is adhered temporarily to the residual framework but not the cutouts using a release liner. The topsheet serves to hold the cutouts in position, and can be peeled back to expose the cutouts which are heavily perforated and so free floating under the topsheet, and joined by the divider. Following removal of the topsheet, the divider/cutouts can be removed as a single piece, and then stripped with the stripper as previously described. In some embodiments the coversheet further comprises one or more tabs at one or each end, which can serve to anchor the coversheet ends, act as finger holds to facilitate separation of layers from each other, or which can be gripped to facilitate pulling of the coversheet. The tab may be any shape and conformation suitable for gripping, and may be integral to the coversheet, comprising a flattened and reinforced section. It may additionally comprise a mechanism to secure the free end to the coversheet.

A second element comprises one or more dividers, which are spot adhered to the cutouts of the coversheet and serve to release the cutouts when pulled upon. In some embodiments the divider may comprise a filament or tape, often ending in a tab, which overlays, underlays or is woven within the coversheet and threads between and is adhered to each of the cutouts, connecting them in a linear or random fashion. In other embodiments the divider comprises a broad tape or sheet which overlays the entire printed surface and is spot adhered to the underlying cutouts with an intervening stripper layer. When the divider is a thread or string, it is attached at one terminus to the final cutout of the series. At the other terminus, the divider is passed through a stripper, and may end in a tab which serves to anchor and/or release the divider depending on the embodiment, as further described below. This "free end" of the divider over or underlays the residual framework of the coversheet and/or the stripper and is attached temporarily or permanently thereto. In some instances the free end of the divider is attached juxtaposed to a side or corner to facilitate easy release. When the divider is a filament or tape, pulling on the divider by the free end results in release of the cutouts from the coversheet, in a daisy chain configuration, with individual cutouts arrayed along the length of the released divider. In some embodiments the divider comprises a sheet or broad tape which completely covers the printable surface of the coversheet and is spot adhered to the cutouts through an intervening stripper layer which sits between the coversheet and divider, and is detailed further below. The divider will typically be a string, thread, ribbon, tape or sheet, composed of any suitable material. In some embodiments the divider further comprises one or more tabs as described previously at one or each end, which can serve to anchor the divider ends, act as finger holds to facilitate separation of layers from each other, or which can be gripped to facilitate pulling of the divider. In some embodiments, a plurality of dividers may terminate in a single tab, with a handle such that multiple lines of text can be erased simultaneously. In some embodiments the divider overlays the cutouts and further comprises a surface which can be written or printed upon, so that the coversheet and divider present as a uniform writable surface. In this embodiment the divider may be shaped as a tape or other flattened surface and employ an integral tab.

A third element of the invention comprises one or more stripping devices, or strippers, which act to sever the connection between the divider and the cutouts following their release from the coversheet, discharging them as chads. When the divider is a tape or filament, the stripper may comprise a ring, tube or collar with an internal diameter slightly larger than that of the divider which it encircles, and may or may not be attached to the coversheet. The stripper may be a collar of any size or shape, as long as it is able to accommodate and be drawn unimpeded along the length of the divider. In some instances a plurality of strippers are formed into a single "stripper unit" encircling a plurality of dividers. By holding the divider terminus or tab and drawing the stripper along the length of the divider, the cutouts which are adhered to the divider after release from the coversheet are stripped away as they are drawn into the stripper, and released from the divider as discrete chads. The stripper my further comprise an optional set of blades inset into the stripper, a shredder, so that chads are shredded, being cut by the blades as they encounter the stripper. This makes the chads more indistinct and adds a further layer of security to the invention.

In some embodiments, when the divider comprises a broad tape or sheet, the stripper comprises an intervening layer of appropriate size which is positioned between the coversheet and the divider and is covered with small holes. These holes may be of any shape and size and overlay the cutouts allowing the divider to be spot adhered to the cutouts. Similarly the spot adhesion may be of any size, shape and number such that the cutouts are firmly adhered through the holes to the divider without adhering to the stripper. The stripper may additionally be adhered to the divider to facilitate release of the cutouts, stripper and divider as one from the coversheet and may employ a more or more tabs as described above at one or each end to facilitate release and separation of layers from each other, or which can be gripped to facilitate pulling of the stripper.

Pulling the divider layer away from the stripper layer using the tab breaks the adhesive bonds to the cutouts resulting in their release as chads. In some embodiments the cutouts are fully perforated and held in position on the coversheet by the adhesive contacts with the divider. In this embodiment the stripper is additionally temporarily adhered to the coversheet residual framework to facilitate release of the coversheet, cutouts, stripper and divider as one from the package or backing sheet. The writable surface is destroyed by pulling the divider layer away from the stripper layer using the tab which breaks the adhesive bonds to the cutouts resulting in their release as chads. The residual framework and each chad contain a small piece of random information, and may be safely discarded without risk of information reconstruction.

The stripper may be attached to either the divider and/or the coversheet residual framework, in either a permanent or temporary fashion, or may be unattached and held in place by the divider. In some embodiments the stripper may further comprise a handle to assist gripping. In one embodiment of the invention, the stripper is attached permanently to the coversheet residual framework and the cutouts and divider are released in a single motion by drawing the divider through the stripper affixed to the coversheet, with chads being released from the divider as it passes through the stripper. In a preferred embodiment the affixed stripper is formed with finger-holds to facilitate gripping of the document. In an alternative embodiment the stripper may be attached temporarily to the coversheet residual framework so as to hold it in place prior to use. In this embodiment the stripper and divider are released in a first motion by pulling on the divider end or tab, resulting in the separation from the coversheet residual framework of both the stripper and the divider with its attached released cutouts. In a second stripping motion, the stripper is then drawn away from or along the length of the released divider so as to discharge the cutouts as chads. In some embodiments, a plurality of strippers may be formed into a single stripper unit and attached to the coversheet residual framework such that multiple dividers may be stripped simultaneously. In this embodiment a plurality of dividers pass through the stripper unit and terminate in a single tab with a handle. Pulling on the tab releases the cutouts and strips multiple dividers in a single motion. In a further embodiment, a plurality of strippers may be formed into a single stripper unit which is not attached to the coversheet residual framework but is held in place by a plurality of dividers affixed to the coversheet. In this embodiment the stripper unit is pulled along the plane of the dividers and across the face of the document, such that multiple dividers may be stripped simultaneously in situ.

A fourth optional element of the invention comprises a backing sheet and optional release liner. By including a backing sheet, the document of the invention can be strengthened, or can be affixed to items as desired. The backing sheet comprises an upper surface to which a coversheet can be adhered. Characteristically the upper surface has the properties of a release liner, i.e. coated with polyolefins such as HDPE, LDPE and PP plastic resins, silicon, polyvinyl alcohol or other suitable components, which may cover all or part of the backing sheet and allows a reliable but temporary bond to the lower surface of the coversheet. This facilitates sticking to the coversheet, but allows subsequent release of the perforated cutouts from the upper surface of the backing sheet. In some embodiments of the invention, the backing sheet has no adhesive applied to its lower surface, and acts to strengthen the overlaying coversheet by bonding thereto. In other embodiments the lower surface of the backing sheet comprises a second adhesive surface capable of affixing to a mailing or other surface and is usually protected by a release liner. In some embodiments, the lower surface may be coated in an adhesive, with or without an optional release liner, and can be adhered to a mailing or other surface by any of those techniques known in the art. For instance, the lower surface may typically comprise a simple sticker, with a pressure sensitive adhesive covering the surface. The adhesive is protected by a release liner, to safeguard the adhesive prior to the label being applied as is common in the sticker industry. Characteristically, similarly to the upper surface of the backing sheet, the release liner comprises an upper surface which is coated with silicon, polyvinyl alcohol or other suitable components, to reduce the stickiness of the surface, and allow a reliable but temporary bond to a second adhesive coated surface. The attached release liner can be peeled away from the backing sheet to expose the adhesive covered lower surface to facilitate affixing to a mailing or other surface. Alternatively the adhesive on the lower surface of the backing sheet may be uncovered, and require activation by water, light, temperature or other means known in the art, and in this instance the optional release liner may be omitted.

The exact choice or combination of materials employed in construction of the invention depends on the specific application and embodiment. Suitable materials are known, or will become known, to those skilled in the art, and their exclusion from this list is not intended to detract from their importance in this invention. In any case, suitable materials and methods are well known in the art and the following is intended to illustrate, not limit, the choices of materials which may be employed. Typically, the coversheet, backing sheet and release liner are composed of papers or cardboards, e.g. any pulp of wood or other fibrous products as known in the art. In some embodiments these elements are composed of cloth or other woven materials. Alternatively plastics and other organic polymers may be used. In certain applications metallic foils and alloys may also be advantageous. In certain applications thermal active materials and thermal printing may be employed to print through overlying layers. The divider may also be composed of the above materials and may be the same or different material to the coversheet. The divider may additionally be composed of string, thread or other rope or ribbon-like fibrous materials. Likewise the stripper, handle and tab may be constructed from the variety of materials listed above.

The adhesive may be of any type commonly used in the production of stickers and labels. For instance, the adhesive may be permanent, peel able or high tack. The adhesive chosen for each of the surfaces will best suit the task at hand. For instance, a relatively strong bond is needed between the backing sheet and the mailing to ensure fastening, while a relatively weaker bond might be employed between the backing sheet and coversheet so as to facilitate easy release of the cutouts upon drawing of the divider. Any materials and method known in the art which produces a firm bond of the lower surface to a mailing, and a releasable bond between the upper surface and coversheet is contemplated within the scope of the instant invention.

The principle advantage of the invention over the art is the combination of simplicity and security features afforded. As the advantage is integral to the invention and does not require extraneous equipment there is minimal incremental cost and no further ongoing costs or requirements. Furthermore the invention provides for easy manufacturing using current techniques. As described, following destruction the text is broken into three physically distinct parts, that on each of the released cutouts, that on the residual framework, and that on the divider. Following document destruction, each separate part contains components of the text indecipherable in its own right, and triply secure due to the combination of features cited herein. The inclusion of an optional shredder further obfuscates the document by destroying each chad as it is released from the divider.

BRIEF DESCRIPTION OF THE SEVERAL VIEWS OF THE DRAWINGS

The drawings on the first sheet illustrate a first embodiment of the invention, useful in corporate security. FIG. 1A details document components in an exploded view, while FIG. 1B shows a filled document ready for destruction. FIG. 1C illustrates initiation of release of the cutouts and document destruction.

The drawings on the second sheet illustrate a second embodiment of the invention, useful in protection of information during mailing.

The drawings on the third sheet illustrate the typical steps of document destruction.

The drawings on the fourth sheet illustrate an embodiment of the device, wherein a plurality of dividers terminate in a single tab, and pass through a plurality of strippers attached to the coversheet as a single stripper unit. FIG. 4A details document components in an exploded view, including an inset (FIG. 4E) detailing divider end components. FIG. 4B shows a document affixed to a box. FIG. 4C illustrates initiation of release of the cutouts and document destruction, while in FIG. 4D only the residual framework and stripper unit remain on the box.

The drawings on the fifth sheet illustrate an embodiment of the device, in which a plurality of strippers are formed into a single stripper unit which is not attached to the coversheet but is held in place by a plurality of dividers affixed to the coversheet.

The drawings on the sixth sheet illustrate an embodiment of the device, used in the protection of prescription and medical information.

Figure 7:
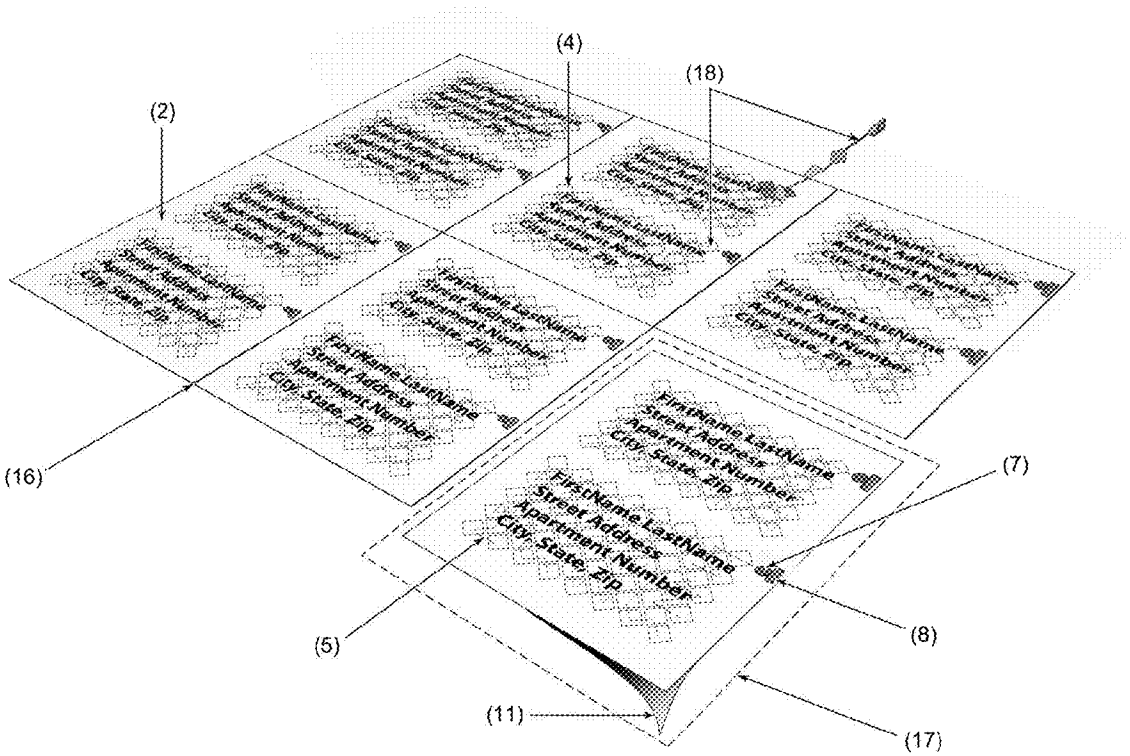

The drawings on the seventh sheet in FIG. 7 illustrate an embodiment of the device, in which multiple labels are formulated as a single sheet.

Figures 8A, 8B, 8C, 8D, 8E:
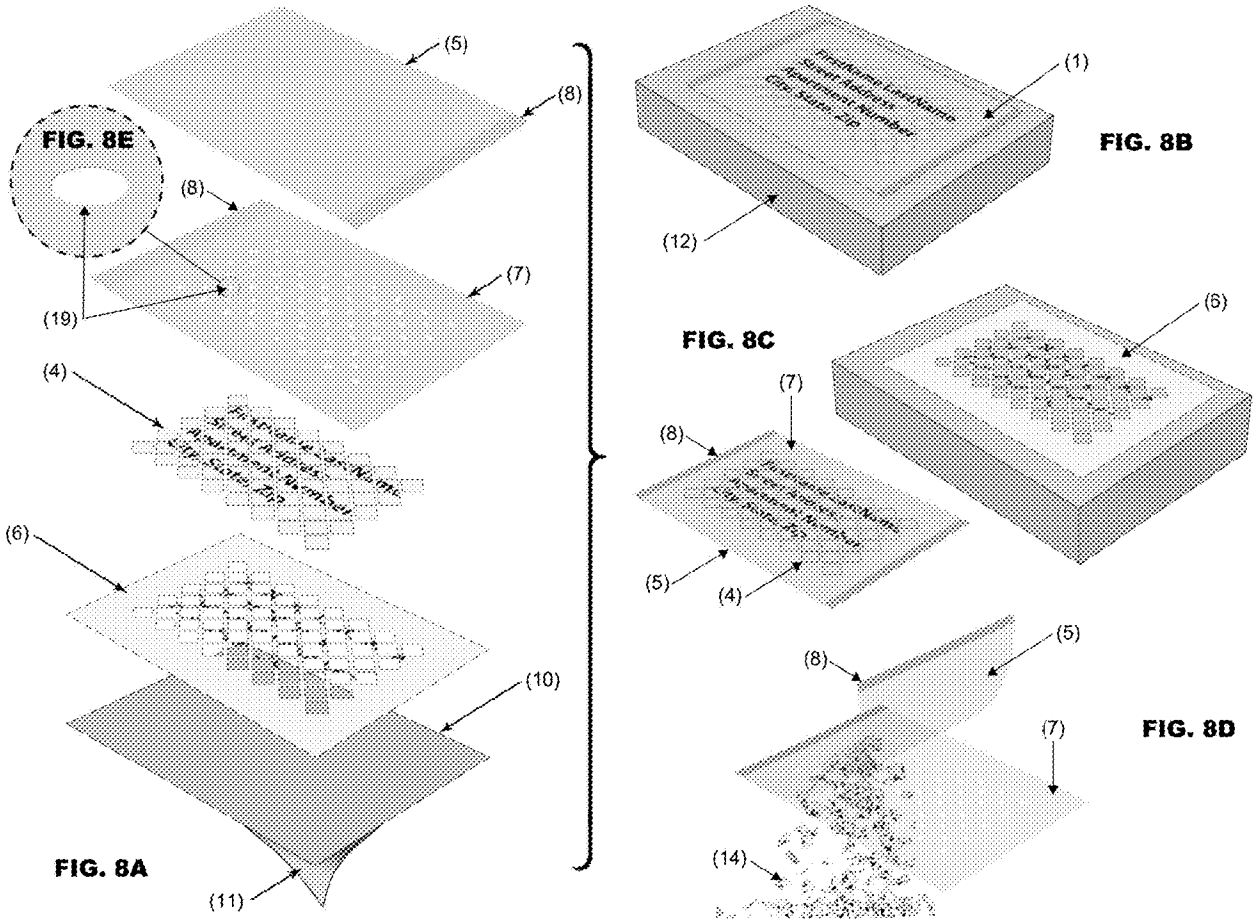

The drawings on the eighth sheet illustrate an embodiment of the device, in which the divider is a sheet. FIG. 8A details document components in an exploded view, including an inset (FIG. 8E) detailing small holes in the stripper layer. FIG. 8B shows a document affixed to a box. FIG. 8C illustrates release of the cutouts, stripper sheet and divider from the box, while in FIG. 8D the cutouts are released from the divider by pulling on the divider or stripper.

Figures 9A, 9B, 9C, 9D, 9E:
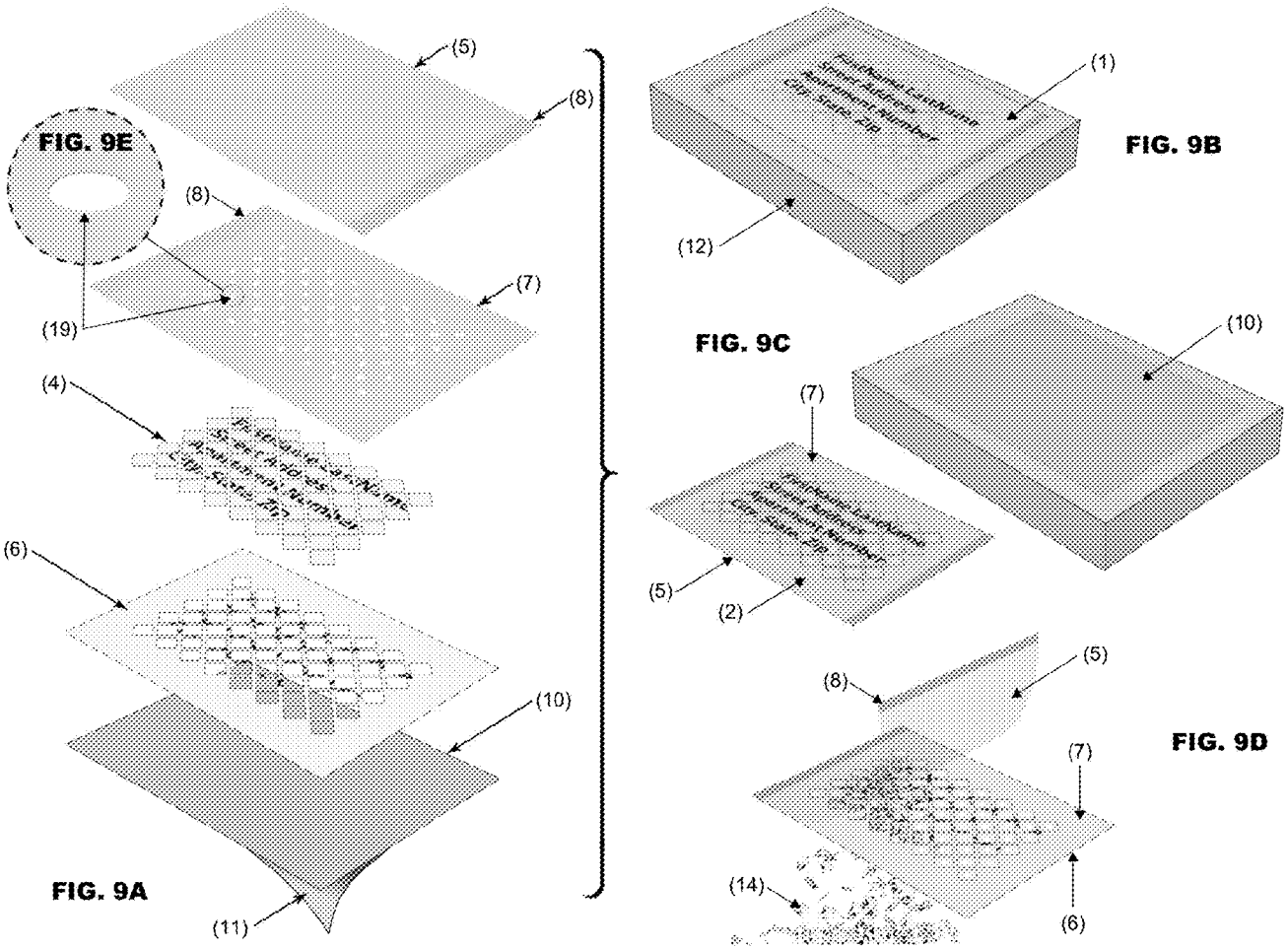

The drawings on the ninth sheet illustrate a further embodiment of the device, in which the divider is a sheet. FIG. 9A details document components in an exploded view, including an inset (FIG. 9E) detailing small holes in the stripper layer. FIG. 9B shows a document affixed to a box. FIG. 9C illustrates release of the coversheet, cutouts, stripper sheet and divider from the box, while in FIG. 9D the cutouts are released from the coversheet and divider by pulling on the coversheet or divider.

DETAILED DESCRIPTION OF THE DRAWINGS

The following drawings are offered to illustrate, but not to limit the claimed invention.

The drawings on the first sheet illustrate a first embodiment of the invention useful in corporate security. Note that the exploded view is used to illustrate the various layers, but in reality the document presents as a uniform surface as seen in FIG. 1B, which shows a document (1) ready for destruction. FIG. 1A illustrates an exploded view of the document and further illustrates the various elements. The embodiment includes a coversheet (2) which has been perforated (3). The perforations form a series of cutouts (4) which can be released from the coversheet by pulling on the divider (5), leaving a residual framework (6). The divider runs through the collar of a stripper (7) and terminates in an optional tab (8). In this embodiment the stripper and/or tab is attached to the coversheet by a temporary bond (9) and is detachable therefrom. In this embodiment the coversheet (2) is lightly perforated (3), such that the cutouts (4) can be easily released by pulling on the divider (5), but the page (1) maintains its integrity and usability prior to release. FIG. 1C shows release of the cutouts and document destruction. At the time of destruction, the document (1) may be placed writing down on a flat surface with the divider side up, anchored at a corner or as desired, and the divider (5) is pulled to release the cutouts, often employing the optional tab (8). As the print is distributed over the entire surface of the document, by removing the cutouts and the information printed thereon, the print remaining on the residual document framework becomes incomprehensible. Next the stripper is pulled along the length of the cutout bearing divider, and the cutouts are released as chads, completely obliterating any data. This process is further detailed in FIG. 3.

Figures 2A, 2B, 2C, 2D, 2E:
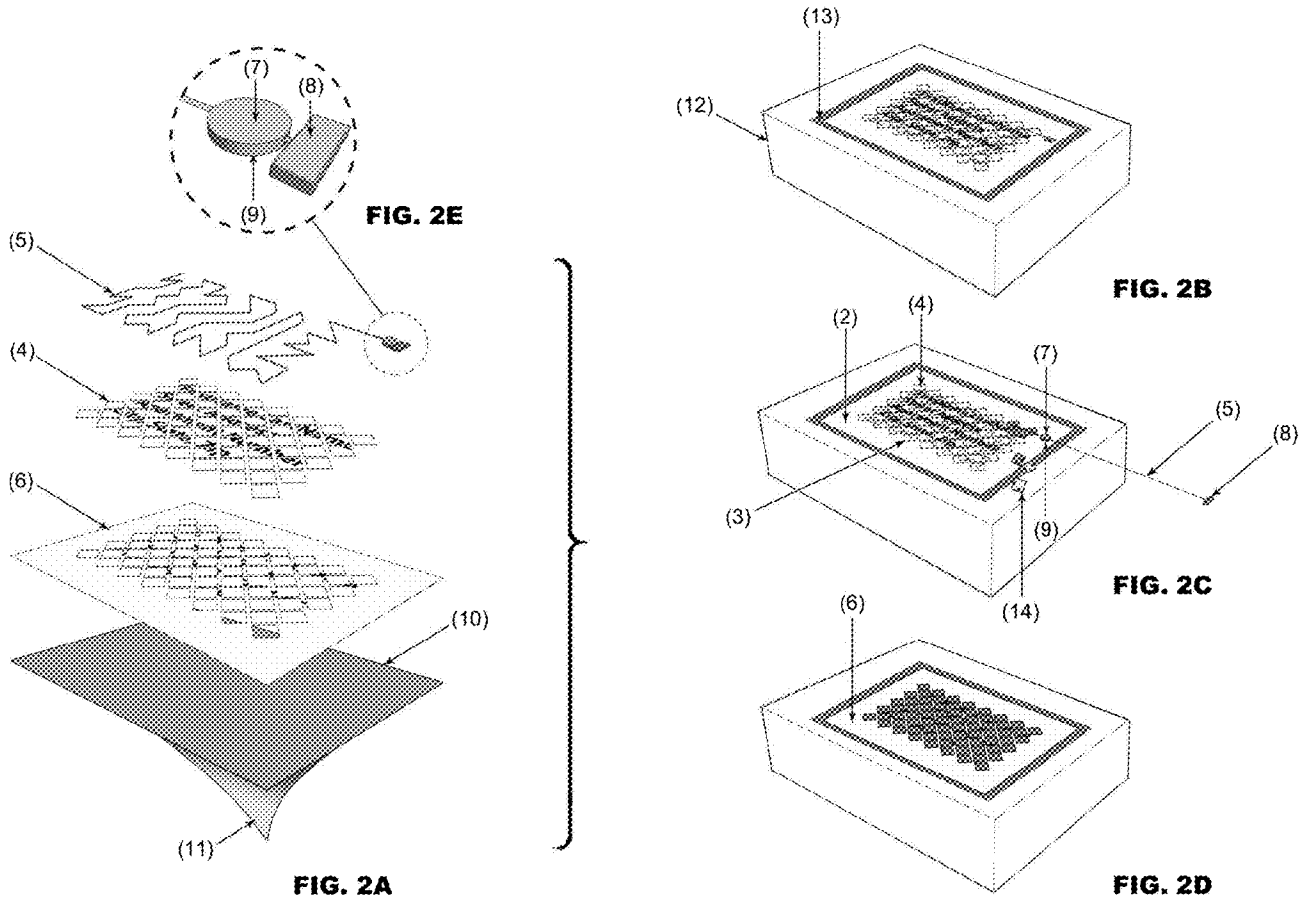
FIG. 2A details document components in an exploded view, including an inset (FIG. 2E) detailing divider end components.
FIG. 2B shows a document affixed to a box and enclosed in a mailing pouch.
FIG. 2C illustrates initiation of release of the cutouts and document destruction, while in FIG. 2D only the residual framework remains on the box.

The drawings on the second sheet illustrate a second embodiment of the invention useful as a solution to the theft of personal information from discarded mailings. FIG. 2A shows an exploded view of a mailing label. As in the earlier figure, the invention comprises a coversheet (2) composed of the residual framework (6) and the cutouts (4), a divider (5) which in this case overlies the coversheet and a stripping device (7) as described above, but additionally comprises a backing sheet (10), with optional release liner (11), which can be adhered to a package, container or mailing (12). Elements at the terminus of the divider (5) are detailed in FIG. 2E, and include the stripping device (7), an optional tab (8) and an attachment point (9). The addition of a backing sheet allows the invention to be attached to items at will. After release of the cutouts (4), the residual framework (6) remains adhered to the backing sheet and mailing. As the print is distributed over the entire surface of the label, by removing the cutouts and the information printed thereon, the print remaining on the residual framework attached to the package or mailing becomes incomprehensible. In FIG. 2B the mailing label is shown adhered to a box (12). In this drawing the label is contained within a mailing pouch (13) and adhered to the box. In FIG. 2C label destruction is initiated by drawing the divider (5) through the stripper (7) using the tab (8), resulting in release of cutouts (4) from the perforated (3) coversheet (2) and displacement of chads (14) from the divider. In FIG. 2D the destructed document now composed only of the residual framework (6) remains adhered to the box. The steps of document destruction are further detailed in FIG. 3. The label of the invention is suitable for all forms of shipping and communications requiring a label, including but not limited to a box, letter, parcel, package, mailing tube, posting, delivery, airmail, shipment, document, note, memo, flyer, newspaper, advertising materials etc.

Figures 3A, 3B, 3C, 3D, 3E:
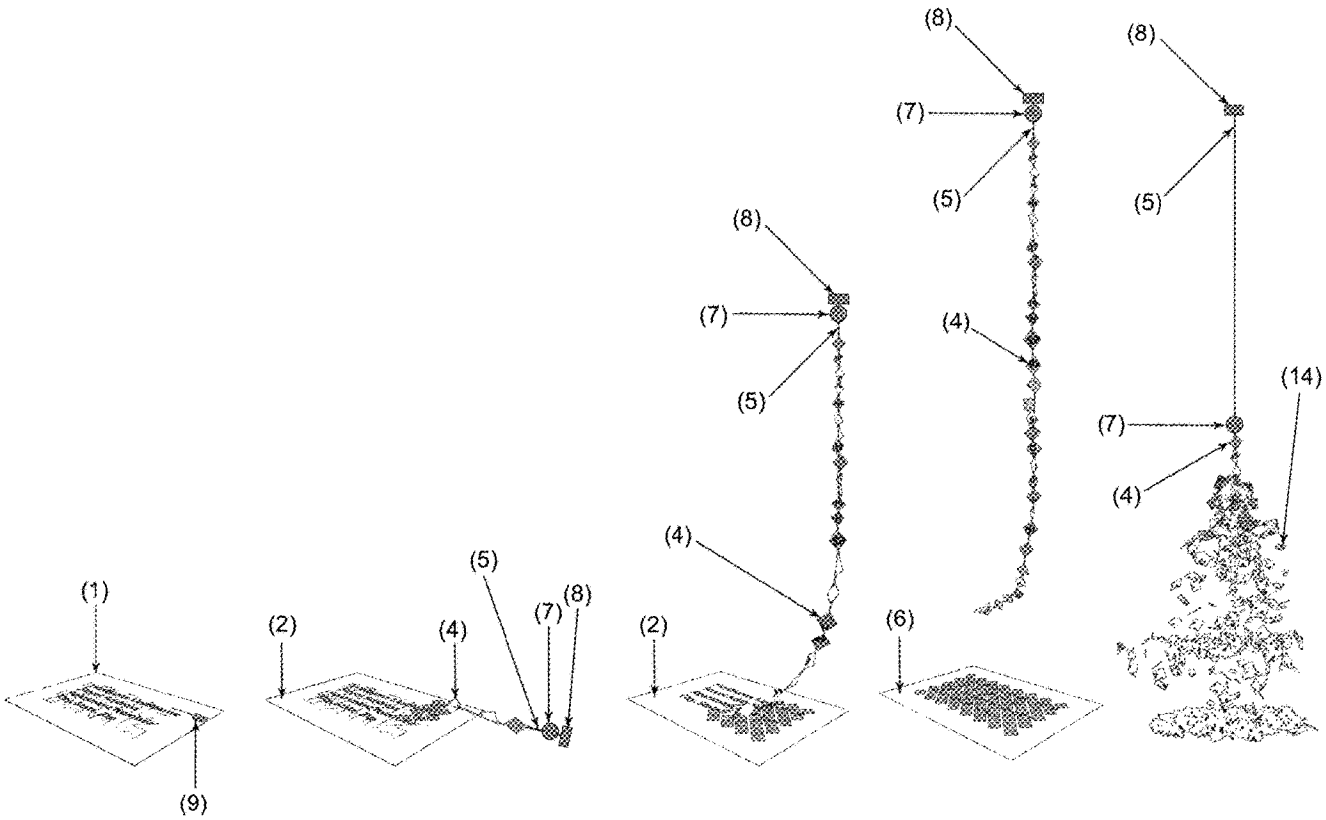
FIG. 3A thru 3E show the steps from a completed document ready for destruction (FIG. 3A) through final release of the divider (FIG. 3D) and removal of chads with the stripper in FIG. 3E.

The drawings on the third sheet illustrate the sequence of steps in destruction of a typical document of the invention. Starting at the left side, FIG. 3A shows a document (1) ready for destruction. In this embodiment, the stripper and tab are temporarily attached (9) to the coversheet. In FIG. 3B the stripper (7) and tab (8) have been released from their attachment (9) to the coversheet (2), after pulling lightly on the tab. FIG. 3C shows the cutouts (4) being released from the coversheet as the divider (5) is drawn by the tab, while in FIG. 3D the divider (5), cutouts (4) and stripper (7) are fully separated from the label, leaving the residual coversheet framework (6) now without cutouts, but still adhered to the underlying backing sheet (not shown in this view, see FIG. 2). Finally in FIG. 3E the divider is grasped by the tab (8) and the stripper (7) is drawn along the length of the divider (5), resulting in release of the cutouts (4) as chads (14), bearing random pieces of text and destruction of the original printed label.

The drawings on the fourth sheet illustrate a third embodiment of the invention useful as a solution to the theft of personal information from discarded mailings. FIG. 4A shows an exploded view of a mailing label. The invention comprises a coversheet (2) composed of the residual framework (6) and the cutouts (4), a backing sheet (10), with optional release liner (11), which can be adhered to a package, container or mailing (12) as described above. In this embodiment a plurality of dividers (5) terminate in a single rigid tab (8) with handle (19) which is temporarily adhered to the coversheet. The dividers pass through a stripper unit (7) which is permanently attached along one side of the coversheet, and comprises a plurality of strippers equal in number to the divider number, attached to and spaced along the stripper unit so as to align with and encircle the dividers. Elements at the terminus of the dividers (5) are detailed in FIG. 4E, and include the stripping unit (7) permanently attached to the coversheet at an attachment point (9), and a tab (8), with handle (19) temporarily attached to the coversheet. In FIG. 4B the mailing label is shown adhered to a box (12). In FIG. 4C label destruction is initiated by breaking the bond between the tab and coversheet, and drawing the dividers (5) through the stripper unit (7) attached to the coversheet, by drawing the tab (8) using the attached handle (19). This results in the simultaneous release of all rows of cutouts (4) from the perforated (3) coversheet (2) and displacement of chads (14) from the divider. In FIG. 4D the destructed document now composed only of the stripper unit (7) and residual framework (6) which remains adhered to the box. The label of the invention is suitable for all forms of shipping and communications requiring a label, including but not limited to a box, letter, parcel, package, mailing tube, posting, delivery, airmail, shipment, document, note, memo, flyer, newspaper, advertising materials etc.

Figures 5A, 5B, 5C, 5D, 5E:
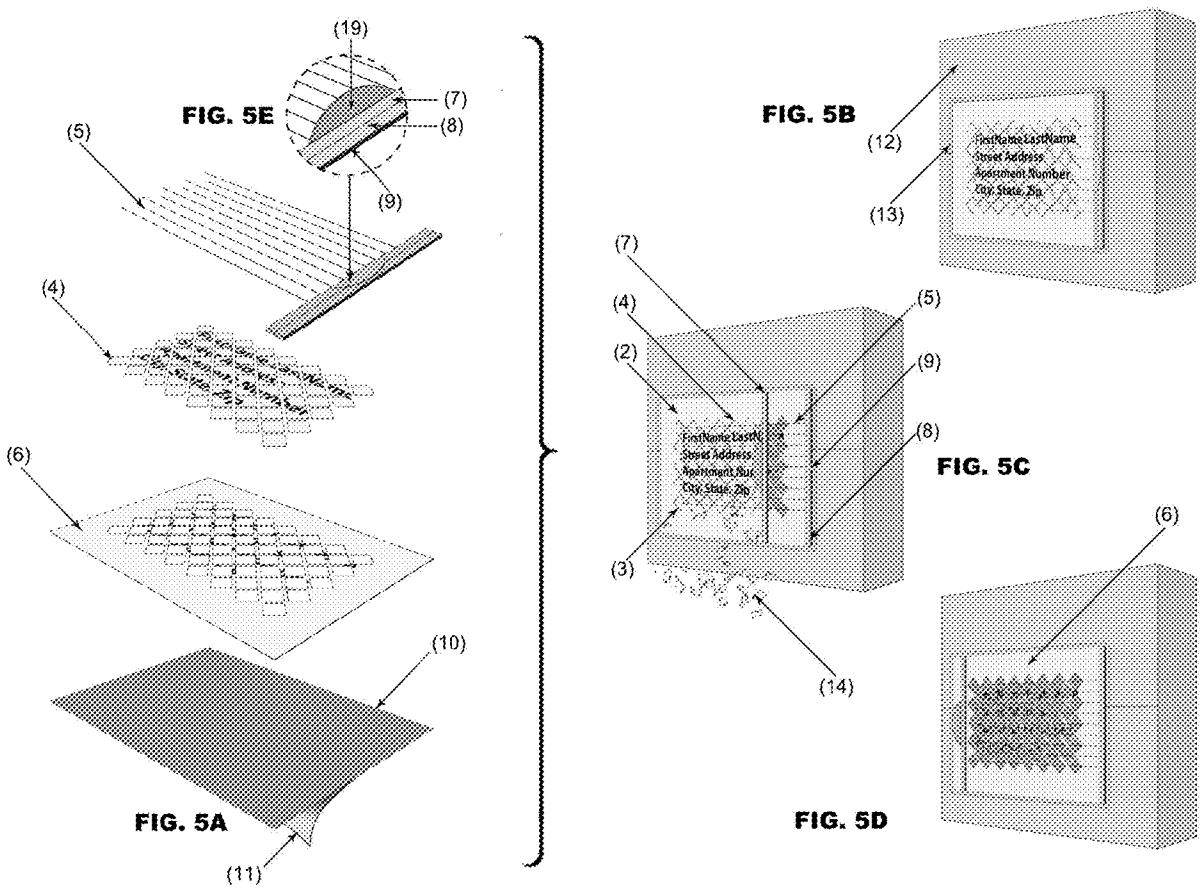
FIG. 5A details document components in an exploded view, including an inset (FIG. 5E) detailing divider end components.
FIG. 5B shows a document affixed to a box.
FIG. 5C illustrates initiation of release of the cutouts and document destruction, while in FIG. 5D everything except the chads remain on the box.

The drawings on the fifth sheet illustrate a fourth embodiment of the invention useful as a solution to the theft of personal information from discarded mailings. FIG. 5A shows an exploded view of a mailing label. The invention comprises a coversheet (2) composed of the residual framework (6) and the cutouts (4), a backing sheet (10), with optional release liner (11), which can be adhered to a package, container or mailing (12) as described above. In this embodiment a plurality of dividers (5) terminate in a single rigid tab (8), which is permanently attached to the coversheet. The dividers pass through a stripper unit (7) with handle (19) which comprises a plurality of strippers equal in number to the divider number, attached to and spaced along the stripper unit so as to align with and encircle the dividers. In this embodiment the stripper unit is not adhered to the coversheet but rides along the dividers it encircles, and so using the handle can be pulled horizontally across the face of the label so as to simultaneously displace the rows of cutouts from the coversheet, and strip the dividers of chads as the stripper unit passes across the document face. Elements at the terminus of the dividers (5) are detailed in FIG. 5E, and include a tab (8) permanently attached to the coversheet, and a stripper unit (7) with handle (19). In FIG. 5B the mailing label is shown adhered to a box (12). In FIG. 5C label destruction is initiated by pulling on the handle (19) so as to pass the stripper unit (7) horizontally across the face of the document (2) along the dividers (5). This results in the simultaneous release of all rows of cutouts (4) from the perforated (3) coversheet (2) and displacement of chads (14) from the divider. In FIG. 5D the stripper unit (7) has completed its pass and the destructed document retains all portions of the device except the cutouts which are expelled as chads hence obliterating any data. The label of the invention is suitable for all forms of shipping and communications requiring a label, including but not limited to a box, letter, parcel, package, mailing tube, posting, delivery, airmail, shipment, document, note, memo, flyer, newspaper, advertising materials etc.

Figure 6A:
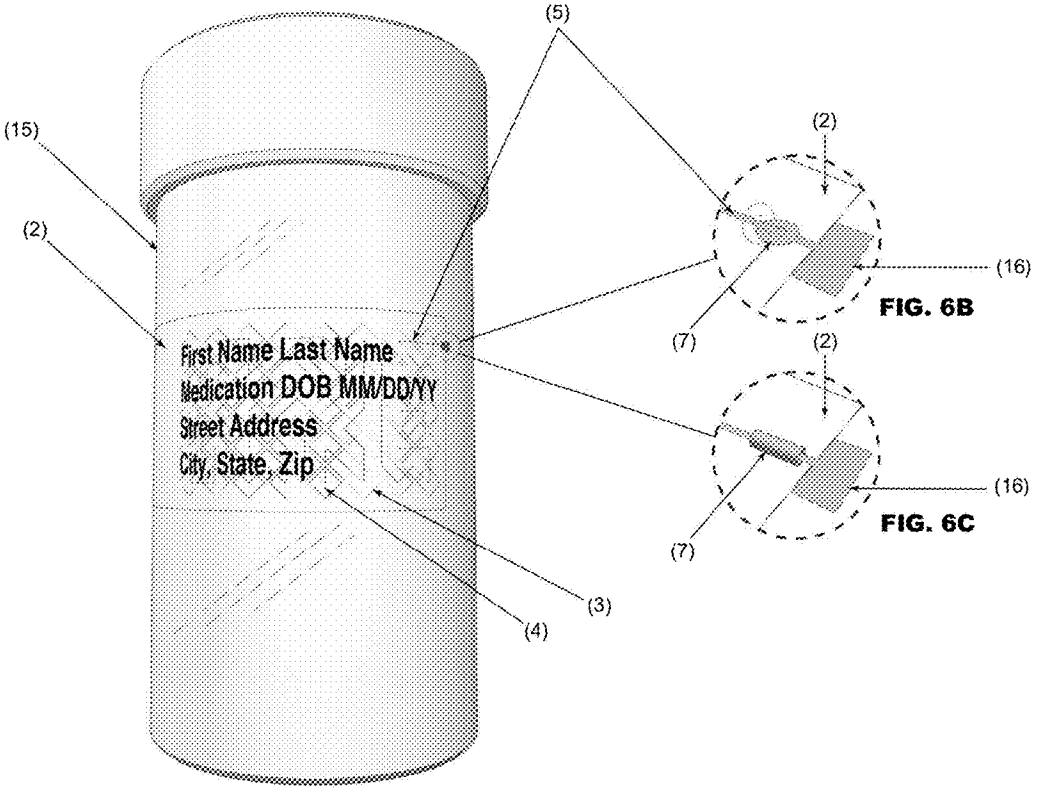
In FIG. 6A a label of the invention is affixed to a prescription container. Insets (FIG. 6B and FIG. 6C) detail alternative embodiments of the stripper element.

The drawings on the sixth sheet illustrate an embodiment of the device, used in the protection of prescription and medical information. A label of the invention is affixed to a prescription container (15). This embodiment comprises the elements listed above, including a coversheet (2), perforations (3), cutouts (4), and divider (5), but to facilitate the label sitting flush with the container, the tab is omitted and the divider end modified stiffened or reinforced (16). The insets (FIG. 6B and FIG. 6C) show two embodiments of the divider end/stripper. In FIG. 4B the divider has a reinforced end (16) which is integral to the divider (5) and which can be utilized as a tab. In this embodiment the stripper (7) encircles and is folded flat against the divider so as to sit flush with the coversheet and container. The divider end (16) and stripper (7) are temporarily adhered to the coversheet (2) and released by lightly pulling to initiate release of cutouts. In FIG. 6C the stripper (7) is a cylinder which is permanently affixed to the coversheet (2). divider and cutout release is performed in situ, with the divider (5) drawn through the stripper (7) while it is still attached to the container.

The drawings on the seventh sheet in FIG. 7 illustrate the use of multiple label panels (17) incorporated into a single sheet (16). The elements of the invention are as previously described and include coversheets (2) with cutouts (4), and interconnecting dividers (5) with attached strippers (7) and tabs (8). As the backing sheet and release liner (11) are perforated at the edge of each panel, each instance of the label may be independently applied. In the illustration six panels, each comprising a duplicate copy of a label, are shown as one sheet. In the bottom right, a panel with a set of duplicate labels (17) is shown partitioned from the sheet (16). The top central panel illustrates the use of multiple dividers on a single label (18). divider release results in destruction of information from the upper portion of the panel, but leaves information intact on the lower portion for a later time. Hence each divider can be drawn independently to release cutouts from one or more portions of the coversheets, while leaving the adjacent text intact for a later time.

The drawings on the eighth sheet illustrate an embodiment of the device in which the divider is a broad tape or sheet. FIG. 8A shows an exploded view of a mailing label (1). The invention comprises a thermal active coversheet composed of the residual framework (6) and the cutouts (4), a backing sheet (10), with optional release liner (11), which can be adhered to a package, container or mailing (12) as described above. In this embodiment an intervening stripper sheet (7) is positioned between the coversheet and divider sheet (5). Small holes (19) in the stripper sheet allow the divider sheet to be bonded directly to the underlying cutouts holding it in place, see inset FIG. 8E. The stripper sheet may additionally be bonded to the periphery of the divider (5) and/or the residual framework (6) of the coversheet and feature one or more release tabs (8) to allow the various layers to be detached. In FIG. 8B the mailing label (1) is shown adhered to a box (12). In FIG. 8C the divider (5) and stripper (7) have been removed from the box using the release tab (8), along with the adhered cutouts (4), leaving the residual framework (6) attached to the box. In FIG. 8D document destruction is completed by detaching the divider (5) from the stripper (7) using a second release tab (8) so that cutouts are released as chads (14).

The drawings on the ninth sheet illustrate a further embodiment of the device in which the divider is a broad tape or sheet. FIG. 9A shows an exploded view of a mailing label (1). The invention comprises a thermal active coversheet composed of the residual framework (6) and the cutouts (4), a backing sheet (10), with optional release liner (11), which can be adhered to a package, container or mailing (12) as described above. In this embodiment an intervening stripper sheet (7) is positioned between the coversheet and divider sheet (5). Small holes (19) in the stripper sheet allow the divider sheet to be bonded directly to the underlying cutouts holding it in place, see inset FIG. 9E. The stripper sheet is additionally temporarily bonded to the periphery of the divider (5) and the residual framework (6) of the coversheet and features one or more tabs (8) to allow the various layers to be detached or separated. In FIG. 9B the mailing label (1) is shown adhered to a box (12). In FIG. 9C the coversheet with cutouts (4) and residual framework (6), the stripper (7) and the divider (5) have been removed from the box using a first release tab (8), leaving the backing sheet (10) attached to the box. In FIG. 9D document destruction is completed by detaching the divider (5) from the stripper (7) and adhered residual framework using a second release tab (8) so that cutouts are released as chads (14). The label of the invention is suitable for all forms of shipping and communications requiring a label, including but not limited to a box, letter, parcel, package, mailing tube, posting, delivery, airmail, shipment, document, note, memo, flyer, newspaper, advertising materials etc.

DESCRIPTION OF EMBODIMENTS

It is understood that the figures, examples and embodiments described herein are for illustrative purposes only and that various modifications or changes in light thereof will be suggested to persons skilled in the art and are to be included within the spirit and purview of this application and scope of the appended claims. The following examples are offered to illustrate, but not to limit the claimed invention, and none of the limitations implied in the example embodiments should be construed as limiting on the claims. All publications, patents, and patent applications cited herein are hereby incorporated by reference in their entirety for all purposes.

As the invention comprises certain optional elements, it can be tailored for each desired use. The tab, shredder, backing sheet and the associated release liner are all optional elements of the invention, with their inclusion or exclusion in each embodiment depending on the application selected. Further the divider may under or overlay the coversheet and numerous mechanisms for attachment of the divider, stripper and/or tab are contemplated.

Example 1

This example provides a solution to the theft of corporate information, for instance communications produced within a controlled work environment. As shown in FIG. 1A, the invention comprises a coversheet, a divider and a stripping device and may further comprise an optional tab. In this embodiment the coversheet is perforated such that the cutouts can be easily released by pulling on the divider, but the page maintains its integrity and usability prior to release. At the time of destruction, the document is placed on a flat surface with the text down, divider side up, anchored at a corner or as desired (eg. with a hand), and the divider is pulled to release the cutouts. As the print is distributed over the entire surface of the document, by removing the cutouts and the information printed thereon, the print remaining on the residual document framework becomes incomprehensible. Next the stripper is pulled along the length of the cutout bearing divider, sometimes employing the optional tab, and the cutouts are released as chads, completely obliterating any data. The addition of an optional shredder further obfuscates any data. In a preferred embodiment, the divider underlays the coversheet so as to present a uniform upper writing surface. In a further embodiment, the label may contain a single panel with one or more instances of the present invention, or may have multiple panels each featuring zero or more instances of the present invention. The panels may be adjoined or present as individual components. By providing a quick, simple and integrated system to remove all identifying information from a confidential document, the invention provides corporations a way of protecting theirs or their client's information from capture and abuse. As no extraneous equipment is required and the destruction can be achieved in situ, ease of use and compliance are maximized. The label of the invention is suitable for all forms of confidential communications, including but not limited to letters, documents, notes, memos, drawings, graphics, sketches, graffiti, doodle, cards, sheets, rolls, reams and images.

Example 2

This example provides a further solution to the theft of corporate information, for instance communications produced within a controlled work environment. As previously, the invention comprises a coversheet, a divider with optional tab, and a stripping device, and further comprises a backing sheet. In this embodiment the backing sheet does not have an adhesive covered lower surface, and the optional release liner is omitted. The addition of the backing sheet supports and strengthens the overlaying coversheet, and affords and more robust document when circumstances require. In this embodiment the coversheet may be more heavily perforated, as the cutouts are supported by and adhered to the underlying, unperforated, backing sheet. In this embodiment the divider overlays the coversheet and comprises a writable surface. In a further embodiment the cutouts may be completely severed from the coversheet, but held in place by an optional clear topsheet which is adhered temporarily with release liner to the residual framework of the coversheet, but not the cutouts. Following removal of the topsheet, the now free floating cutouts are extracted using the divider, and the attached stripper is then drawn along its length the release the cutouts. In a further embodiment, the label may contain a single panel with one or more instances of the present invention, or may have multiple panels each featuring zero or more instances of the present invention. The panels may be adjoined or present as individual components. Like the previous embodiment, this embodiment finds utility in the protection of all forms of confidential communications, including but not limited to corporate documents.

Example 3

This example provides a solution to the theft of personal information from discarded mailings and containers. As shown in FIG. 2A, the invention provides a mailing label comprising a coversheet, a divider, a stripping device and a backing sheet as described above, but in this embodiment the lower surface of the backing sheet is coated with an adhesive, with optional release liner, which can be adhered to a package, container or mailing. The addition of a backing sheet allows the invention to be attached to items at will. In this embodiment the coversheet may be more heavily perforated, as the cutouts are supported by and adhered to the underlying, unperforated, backing sheet. The cutouts may be removed from the coversheet by pulling on the divider and peeling from the backing sheet, separating at the perforations, while the residual framework remains adhered to the backing sheet. As the print is distributed over the entire surface of the label, by removing the cutouts and the information printed thereon, the print remaining on the residual framework attached to the package, container or mailing becomes incomprehensible. In a preferred embodiment the divider overlays the coversheet and comprises a writable surface. In a further preferred embodiment, the label may contain a single panel with one or more instances of the present invention, or may have multiple panels each featuring zero or more instances of the present invention. The panels may be adjoined or present as individual components. In a further preferred embodiment, the label may be enclosed in a mailing bag, behind a mailing window or may be affixed permanently or temporarily thereto. In this embodiment the adhesive lower surface and associated release liner of the backing sheet may be omitted. The bag may include one or more pouches configured to receive shipping labels. In some embodiments of the invention, the bag may include a single pouch that is viewable from either side of the bag, thereby allowing the bag to receive a label for mailing either, or both, to and from the recipient. In some embodiments of the invention, the bag may include a pouch that can be accessed from either side of the bag, or may comprise two or more pouches that may be proximate to each other, or at different locations in the bag. The bag may be closed by any suitable means, including but not limited to a zipper, channel, zip-lock style closure, hook and loop closure, adhesive closure, mechanical closure, etc. By providing a quick, simple and effective way to remove all identifying information from a mailing label, the invention provides both consumers and mailers with a way of protecting theirs or their client's information from capture and abuse. The label of the invention is suitable for all forms of shipping and communications requiring a label, including but not limited to a box, letter, parcel, package, mailing tube, posting, delivery, airmail, shipment, document, note, memo, flyer, newspaper, advertising materials etc.

Example 4

This example provides a solution to the theft of personal information from discarded mailings and containers in which a single tab with handle is used to draw multiple dividers through a stripper unit. As shown in FIG. 4A, the invention provides a mailing label comprising a coversheet, a plurality of dividers, a stripping unit, a tab with handle and a backing sheet with release liner, which can be adhered to a package, container or mailing. In this embodiment a plurality of dividers terminate in a single rigid tab with an attached handle which is temporarily adhered to the coversheet. Each divider passes through a stripper unit which is permanently attached along one side of the coversheet, and comprises a plurality of strippers equal in number to the divider number, attached to and spaced along the stripper unit so as to align with and encircle the dividers. When the tab is pulled by the attached handle, the dividers are drawn thru the stripper unit, releasing the cutouts from the coversheet, and then the chads from the divider. As the print is distributed over the entire surface of the label, by removing the cutouts and the information printed thereon, the print remaining on the residual framework attached to the package, container or mailing becomes incomprehensible.

Example 5

This example provides a solution to the theft of personal information from discarded mailings and containers in which a single stripper unit with handle is used to strip multiple dividers in situ. As shown in FIG. 5A, the invention provides a mailing label comprising a coversheet, a plurality of dividers ending in a tab affixed to the coversheet, a stripping unit with handle threaded through the stripping unit and a backing sheet with release liner, which can be adhered to a package, container or mailing. In this embodiment a plurality of dividers terminate in a single rigid tab which is permanently attached to the coversheet. Each divider passes through a stripper unit which comprises a plurality of strippers equal in number to the divider number, attached to and spaced along the stripper unit so as to align with and encircle the dividers. This stripper unit is not permanently attached to the coversheet, but is held in place by the encircled dividers, or by a temporary attachment to the coversheet. When the stripper unit is passed horizontally along the plane of the dividers and across the face of the document using the attached handle, the dividers are drawn thru the stripper unit, releasing the cutouts from the coversheet, and then the chads from the divider. When the stripper unit has completed its horizontal pass, the device remains intact except that the chads have been removed and expelled from the package. As the print is distributed over the entire surface of the label, by removing the cutouts and the information printed thereon, the print remaining on the residual framework attached to the package, container or mailing becomes incomprehensible.

Example 6

This example provides a series of solutions to the theft of personal and industrial medical information. As previously, the invention comprises a coversheet, a divider, a stripping device, sometimes including an optional shredder, and an adhesive backing sheet, which can be adhered to any item bearing private medical information e.g. a package, container, document or mailing. This embodiment contains all of the elements of example three, but has a specialized divider end comprising a tab integral to the divider. The tab is usually a stiffened extension of the divider which lays flush with the coversheet, presenting a uniform surface for printing and after adhesion to a container. In a preferred embodiment the divider overlays the coversheet and comprises a writable surface. In a further preferred embodiment, the label may contain a single panel with one or more instances of the present invention, or may have multiple panels each featuring zero or more instances of the present invention. The panels may be adjoined or present as individual components. Following advances in the genetic sciences and the subsequent introduction of the Health Insurance Portability and Accountability Act of 1996 (HIPAA), the need for better patient information security has never been greater. This embodiment is well suited for use in the protection of prescription and patient information on pharmaceuticals, container, labels, prescriptions and other items containing such sensitive medical information.

Example 7

This example provides a solution to the theft of personal information from discarded mailings and containers and employs a divider comprising a sheet, along with stripper sheet positioned between the coversheet and divider. As shown in FIG. 8A, the invention provides a mailing label comprising a thermal active coversheet and a backing sheet with release liner, which can be adhered to a package, container or mailing. Overlaying the coversheet is a stripper sheet which covers the writable portion of the coversheet and has small holes aligned over each of the cutouts. Overlaying the stripper sheet is a divider sheet at least equal in size to the stripper sheet. The divider sheet is spot adhered to the cutouts of the coversheet through the small aligned holes in the stripper, and is temporarily adhered at all or portions of its periphery to the underlying stripper sheet. Additionally it is temporarily adhered at all or portions of its periphery to the underlying coversheet to form a sandwich of the layers. In this embodiment text can be applied to the coversheet through the overlying stripper and divider sheets using thermal printing. Alternatively in instances in which a backing sheet is not present, text may be applied to the lower surface of the coversheet and the invention inserted into a clear mailing pouch text side showing. In order to destroy the label, the divider and stripper are first released from the coversheet using an end tab on the divider. The cutouts remain spot adhered to the divider and are released from the residual framework in this motion. Then the divider and stripper are detached from each other by pulling on a second tab. As the cutouts are unable to pass through the small holes of the stripper, the adhesive bond to the divider is broken and the cutouts fall away as random chads. As the print is distributed over the entire surface of the label, by removing the cutouts and the information printed thereon, the print remaining on the residual framework attached to the package, container or mailing becomes incomprehensible.

Example 8

This example provides a solution to the theft of personal information from discarded mailings and containers and employs a divider comprising a sheet, along with stripper sheet positioned between the coversheet and divider. As shown in FIG. 9A, the invention provides a mailing label comprising a thermal active coversheet and a backing sheet with release liner, which can be adhered to a package, container or mailing. Overlaying the coversheet is a stripper sheet which covers the writable portion of the coversheet and has small holes aligned over each of the cutouts, and is adhered at all or portions of its periphery to the underlying coversheet residual framework. Overlaying the stripper sheet is a divider sheet at least equal in size to the stripper sheet. The divider sheet is spot adhered to the cutouts of the coversheet through the small aligned holes in the stripper, and is temporarily adhered at all or portions of its periphery to the underlying stripper sheet. Additionally it is temporarily adhered at all or portions of its periphery to the underlying coversheet to form a sandwich of the layers. In this embodiment text can be applied to the coversheet through the overlying stripper and divider sheets using thermal printing. Alternatively in instances in which a backing sheet is not present, text may be applied to the lower surface of the coversheet and the invention inserted into a clear mailing pouch text side showing. In order to destroy the label, the coversheet, stripper and divider are first released from the backing sheet using an end tab on the coversheet to release the other elements from the backing sheet. Then the divider and stripper are detached from each other by pulling on a second tab on the stripper. As the cutouts are unable to pass through the small holes of the stripper, the adhesive bond to the divider is broken and the cutouts fall away as random chads. As the invention is now broken into a divider, a coversheet residual framework/shredder and chads, the print remaining becomes incomprehensible.

What is claimed:

1. A self-destructing document comprising a coversheet capable of being written or printed upon, and cut or perforated so as to form a series of island cutouts which can be released from said coversheet by means of pulling on a divider which overlays or underlays and is anchored to said cutouts, and;

a stripper, comprising a sheet or collar capable of releasing said adhered cutouts from said divider.

2. The invention of claim 1 wherein the shapes of the cutouts are chosen to maximize data masking.

3. The invention of claim 1 wherein one or more of said coversheet, said divider or said stripper have one or more tabs at one or both ends.

4. The invention of claim 3 wherein the tab is integral to the divider.

5. The invention of claim 1 wherein the divider comprises a surface which can be written or printed upon, so that the coversheet and divider present as a uniform writable surface.

6. The invention of claim 1 wherein the stripper comprises a sheet which incorporates a pattern of holes that overlap each of said cutouts and facilitates anchoring to said divider.

7. The invention of claim 1 wherein said coversheet is made of thermal printable material.

8. The invention of claim 1 wherein the stripper is attached temporarily to the document.

9. The invention of claim 1 wherein any of said coversheet, said divider or said stripper are transparent.

10. The invention of claim 1 further comprising an underlying backing sheet and;

wherein, said coversheet has a lower adhesive surface which overlays and is temporarily adhered to said backing sheet.

11. The invention of claim 10 wherein said underlying backing sheet further comprises a lower adhesive surface capable of affixing to a mailing or other surface.

* * * * *